United States Patent [19]

Lehnert

[11] Patent Number: 4,706,580

[45] Date of Patent: Nov. 17, 1987

[54] PROCESS TO REHEAT FLUE GASES CLEANED BY THE WET PROCESS

[75] Inventor: Werner Lehnert, Quierschied, Fed. Rep. of Germany

[73] Assignee: Saarbergwerke Aktiengesellschaft, Fed. Rep. of Germany

[21] Appl. No.: 897,070

[22] PCT Filed: Dec. 17, 1985

[86] PCT No.: PCT/DE85/00528

§ 371 Date: Aug. 6, 1986

§ 102(e) Date: Aug. 6, 1986

[87] PCT Pub. No.: WO86/03824

PCT Pub. Date: Jul. 3, 1986

[30] Foreign Application Priority Data

Dec. 20, 1985 [DE] Fed. Rep. of Germany ..... 3446511

[51] Int. Cl.[4] ..... F23J 11/00; F23J 15/00

[52] U.S. Cl. ..... 110/345; 55/220; 55/222; 110/203; 110/204; 110/215

[58] Field of Search ..... 110/203, 215, 204, 345; 55/220, 222

[56] References Cited

U.S. PATENT DOCUMENTS

| | | | |
|---|---|---|---|
| 4,430,951 | 2/1984 | Briedenbach et al. | 110/215 X |
| 4,444,128 | 4/1984 | Monro | 110/215 X |
| 4,509,347 | 4/1985 | Breidenbach et al. | 110/215 X |

*Primary Examiner*—Edward G. Favors

*Attorney, Agent, or Firm*—James Creighton Wray

[57] ABSTRACT

In a process for reheating flue gases originating in furnaces operated with fossils fuels, the flue gases, before being introduced into the chimney, receive heat energy that has been generated in a fluidized bed furnace. Sulfur binding agents are added to the fluidized bed furnace and the flue gases of the this furnace are added to the cleaned flue gases after removal of the suspended dust.

4 Claims, No Drawings

PROCESS TO REHEAT FLUE GASES CLEANED BY THE WET PROCESS

The invention concerns a process to reheat wet cleaned flue gases emanating from furnaces operated with fossil fuels before the gases are introduced into a chimney. The heat energy to be applied to the cleaned flue gases is generated in a secondary furnace.

As a rule, the permissible limit values for the concentration of noxious agents introduced into the atmosphere, such as described in the guidelines for the operation of large furnaces, can only be maintained by treating the entire gas current originating in the furnace, which, in the following will be described as raw gas, in a wet washing process by the addition of suited absorption agents. The clean flue gas exiting the wet washing process, in the following described as clean gas, has a temperature of approximately 40° to 60° C. It is, therefore, necessary to increase the temperature of the clean gas to 80° to 120° C. before it is introduced into the chimney.

One reheating possibility consists in transferring the heat of the hot raw gas, before it is introduced into the wet wash, into a regenerative heat transfer system and to then transfer this heat to the cold clean gas. However, these regenerative heat transfer systems require high investment costs.

It has been suggested to generate the heat energy necessary to reheat the clean gases in a secondary furnace which operates on the basis of environment friendly fuels, such as natural gas, or desulfurized light heating oil. The hot exhaust gases of the secondary furnace are then mixed with the clean gas before it is introduced into the chimney.

A disadvantage of this process consists in the high costs for the necessary high quality fuels.

The invention has the task of making possible a simple and, especially, economic way of reheating the clean gases, such as initially described.

This task is solved according to the invention by generating the heat energy to be added to the cleaned flue gases in a fluidized bed furnace.

The heat energy necessary to reheat the clean gases can be obtained by burning low quality, and, thus, cheap fuels, such as for example, ballast coal or refuse. The obtainable economic advantage, in comparison with the use of expensive fuels, such as natural gas or light heating oil, or high quality coal, such as used for a coal-dust firing, is evident.

The process can be implemented in an especially economic way if, according to a further characteristic of the invention, sulfur binding agents, such as calcite, are added in the fluidized bed furnace and if the exhaust gases of the fluidized bed furnace are added to the clean gas once the suspended dust has been removed. In this way, one can eliminate the heat exchanger otherwise necessary for the indirect transfer of the flue gas heat from the fluidized bed furnace to the clean gases. What is of special consequence is that the flue gases do not have to be led through the wet wash for the removal of noxious agents or of sulfur oxides and then have to be reheated. Due to the relative low combustion temperatures of approx. 750° to 900°, the nitrous oxide formation in a fluidized bed furnace is small anyway.

Additionally, when reheating the flue gases of a power station, an advantage results in that the sludge containing calcium that originates from the cooling water preparation can be added into the fluidized bed furnace as a binding agent for sulfur. This sludge is otherwise not usable and has to be processed and disposed of.

In a suitable way, at least a partial current of the cold clean gas is led through an immersion heating surface placed inside the fluidized bed furnace and the clean gas heated in such a way is then mixed with the remaining flue gas current. This accomplishes a temperature reduction of the flue gases exiting the fluidized bed furnace. This effect is also advantageous for the removal of suspended dust from the flue gases.

What is claimed is:

1. Process to reheat flue gases originating in furnaces operated with fossil fuels cleaned by a wet cleaning process before the cleaned flue gases are introduced into a chimney, comprising, generating the heat energy required to be added to the cleaned flue gases in a secondary furnace, wherein the secondary furnace is a fluidized bed furnace.

2. Process according to claim 1 further comprising, adding sulfur binding agents to the fluidized bed furnace and adding flue gases of the fluidized furnace to the cleaned flue gases after removing suspended dust from the fluidized bed furnace flue gases.

3. Process according to claim 1 wherein the sulfur binding agent comprises sludge that at least partially contains calcium, wherein the sludge is generated by cooling water preparation for power stations.

4. Process according to claim 1 wherein generating heat energy comprises separating a partial stream from the cleaned flue gases and passing the partial stream through an immersion heating surface disposed inside the fluidized bed furnace, wherein the partial stream is heated, and adding the heated partial stream to the remaining flue gases stream.

* * * * *